US009787016B2

(12) United States Patent
Elmvang

(10) Patent No.: US 9,787,016 B2
(45) Date of Patent: Oct. 10, 2017

(54) ELECTRICAL CONNECTOR SYSTEM COMPRISING A HOUSING AND A SELECTOR OUTLET

(71) Applicant: Fischer Lighting ApS, Vanløse (DK)

(72) Inventor: Stig Elmvang, Skovlunde (DK)

(73) Assignee: Fischer Lighting ApS, Vanløse (DK)

( * ) Notice: Subject to any disclaimer, the term of this patent is extended or adjusted under 35 U.S.C. 154(b) by 0 days.

(21) Appl. No.: 14/439,134

(22) PCT Filed: Nov. 12, 2013

(86) PCT No.: PCT/DK2013/050373

§ 371 (c)(1),
(2) Date: Apr. 28, 2015

(87) PCT Pub. No.: WO2014/071958

PCT Pub. Date: May 15, 2014

(65) Prior Publication Data

US 2015/0295341 A1 Oct. 15, 2015

(30) Foreign Application Priority Data

Nov. 12, 2012 (DK) ..... 2012 70694
Nov. 29, 2012 (DK) ..... 2012 70742

(51) Int. Cl.

| | |
|---|---|
| ***H01R 29/00*** | (2006.01) |
| ***H01R 13/502*** | (2006.01) |
| ***H01R 13/642*** | (2006.01) |
| ***H01R 25/00*** | (2006.01) |
| ***H01R 27/02*** | (2006.01) |

(Continued)

(52) U.S. Cl.

CPC ..... *H01R 13/502* (2013.01); *H01R 13/52* (2013.01); *H01R 13/629* (2013.01); *H01R 13/642* (2013.01); *H01R 25/006* (2013.01); *H01R 27/00* (2013.01); *H01R 27/02* (2013.01); *H01R 29/00* (2013.01)

(58) Field of Classification Search

CPC ..... H01R 9/00
USPC ..... 439/52, 956; 200/51.03, 51.06
See application file for complete search history.

(56) References Cited

U.S. PATENT DOCUMENTS 4,008,382 A * 2/1977 De Rosa ..... H01R 13/70 200/42.01
4,158,114 A * 6/1979 Butler ..... H01R 13/70 200/1 R (Continued)

FOREIGN PATENT DOCUMENTS

EP 2190077 5/2010

OTHER PUBLICATIONS

International Search Report for PCT/DK2013/050373, dated Jan. 23, 2014, 4 pages.
Machine translation of EP2190077 to Woertz AG.

*Primary Examiner* — Phuong Dinh
(74) *Attorney, Agent, or Firm* — Dinsmore & Shohl LLP

(57) ABSTRACT

The invention regards a plug comprising a housing, a number of connectors and a selector outlet having a movable selector part whereby the configuration of the connectors may be changed when the selector part is moved. The housing may have a triangular cross section defined by a first side A, a second side B and a third side C and where the number of connectors allows for connection of two or more electrical circuits. The invention also relates to a system of plugs and a method of producing the same.

17 Claims, 12 Drawing Sheets

(51) Int. Cl.

| | |
|---|---|
| ***H01R 13/52*** | (2006.01) |
| ***H01R 13/629*** | (2006.01) |
| ***H01R 27/00*** | (2006.01) |

(56) References Cited

U.S. PATENT DOCUMENTS

| | | | | |
|---|---|---|---|---|
| 4,390,228 | A | 6/1983 | Schleusner | |
| 4,460,811 | A * | 7/1984 | Murr | H01R 13/70 200/11 TW |
| 4,579,407 | A * | 4/1986 | Shimada | H04L 29/06 200/51.04 |
| 4,684,186 | A | 8/1987 | Hetherington | |
| 4,718,853 | A * | 1/1988 | Orbanic | H01R 29/00 200/292 |
| 5,164,544 | A | 11/1992 | Snodgrass et al. | |
| 6,817,884 | B1 * | 11/2004 | Chen | H01R 13/642 439/350 |
| 7,367,810 | B2 * | 5/2008 | Lee | H01R 29/00 439/49 |
| 7,980,902 | B2 * | 7/2011 | Capaldi-Tallon | H01R 9/2608 439/532 |
| 2004/0242074 | A1 | 12/2004 | Lee | |
| 2012/0139511 | A1 | 6/2012 | Chou et al. | |

* cited by examiner

ELECTRICAL CONNECTOR SYSTEM COMPRISING A HOUSING AND A SELECTOR OUTLET

CROSS-REFERENCE TO RELATED APPLICATIONS

This application is the U.S. National Phase of PCT/DK2013/050373 filed Nov. 12, 2013, which claims priority of Danish Patent Application PA 2012 70694 filed Nov. 12, 2012, and Danish Patent Application PA 2012 70742 filed Nov. 29, 2012.

FIELD OF INVENTION

The invention relates to a plug and a system of plugs enabling connection of multiple electronic circuits.

BACKGROUND OF THE INVENTION

When decorating and furnishing shops, hotels etc. numerous electrical installations are made including spots and other lighting devices. This requires connection of multiple cables as well as the use of cables providing different power e.g. 12V, 230V and/or 400V rendering the installation slow and often troublesome. In some cases installations are made above the sealing whereby work must often be performed in hard to reach areas with reduced or no visibility of the work site.

Thus there is a need for plugs and plugs systems which can assist simple and fast installation of multiple devices.

SUMMARY OF THE INVENTION

In a first aspect of the present invention is provided a compact system which is capable of providing more than one electric circuit.

In a second aspect of the present invention is provided a system which facilitates correct alignment of plugs when connected.

In a third aspect of the present invention is provided a system which enables connection of several different power circuits.

In a fourth aspect of the present invention is provided a plug which can form part of plug system.

System

These and other advantages can be achieved by means of a system comprising a housing, a plurality of connectors and a selector outlet, wherein

- the plurality of connectors allows for connection of two or more electrical circuits, and
- the selector outlet has at least a part of the connectors in at least one selector part, and said at least one selector part is movably arranged, whereby a configuration of the connectors is changed when said at least one selector part is moved.

The housing may attain any suitable geometry, such as rectangular, triangular or circular. In particularly, if the housing is rectangular parts of the housing may have a triangular shape, such as the selector outlet may have a triangular shape, whereby the advantages described below in relation to triangular shapes are obtained.

In particularly the part of the housing comprising the selector outlet may have a triangular cross section defined by a first side A, a second side B and a third side C and the number of connectors allows for connection of two or more electrical circuits whereby a compact plug able to provide connection of several electric circuits is provided.

The system according to the present invention may in one embodiment be a plug.

Selector Outlet

The system comprises at least one selector outlet having at least a part of the connectors in at least one selector part, wherein said at least one selector part is movably arranged whereby the configuration of the connectors is changed when said at least one selector part is moved. In particularly, the movement may be a rotation, wherein the configuration of the connectors is changed when said at least one selector part is rotated. I.e. a selector output makes it possible for a user to choose the configuration of the connectors simply by moving, such as rotating the selector part.

The system may comprise one or more selector outlets, each being as defined above.

If e.g. a small plug (as a truncated plug) with five pins (a dali pair, a 230V pair and a ground) is mounted to a spot or other installation it is possible by means of the selector output to choose which of a number of connectors in a distributor plug will match the five pin connectors of the small plug.

Such a selector outlet can advantageously be arranged in e.g. a distributor plug with numerous electric circuits as described above and herein as it allows a user to choose which one or more of the many circuits inside the distributor plug will be connected to a device attached to the selector outlet.

A selector output as here described can however be arranged in various plug types not described herein where there is a need to change the configuration of all of or a part of the connectors.

Often the connector parts can be circular parts which are arranged to be rotatable between two, three, four or more different positions, wherein three different positions are preferred.

If the connectors of the distributor plug are connected to the internal connections by wires inside the plug preferably rotation above 360 deg is prevented by a lock or stop.

Connector parts which are arranged to be moved in e.g. a sliding motion are also imagined.

Thus, according to the present invention is provided a plug and a system of plugs which enable coupling of numerous and different electrical circuits in a manner where the plugs intuitively are correctly aligned by the user due to the shape of the plugs. This means that the present plugs advantageously can be used where many and/or different electrical installations and connections must be made. It also means the present plugs can be handled in hard to reach places as well as in places with limited or no view of the work site. This is achieved by the shape of the present plug together with the way the connectors can be arranged in the plugs and assisted by the guiding parts, sleeves, collars, and coding all in all limiting the possible errors when handling, choosing and connecting the present plugs.

Triangular Cross Section

In the present system the connectors for the two or more electrical circuits can be stacked in a compact formation where the nature of each connector or connector set (e.g. dali+ and dali− or L1 and N1) may be easily recognizable.

The triangular cross section makes it possible to stack the connectors in a compact but yet simple pattern.

A triangular plug according to the present invention with connectors for two or more electric circuits also makes it possible that the plug is fed through a conduit, holes etc. which would not be possible with e.g. a rectangular plug where the connectors would have to be arranged side by side. This is due to the special triangular arrangement providing the possibility for a highly compact plug.

In some embodiments the number of connectors is eleven whereby the triangular plugs capability of containing numerous connectors in an easily overviewed arrangement is used highly efficiently. In other embodiments depending on the intended use the number of connectors can be more or less.

Preferably the lengths of the sides A, B, C are chosen to ensure that two plugs according to the present invention can be oriented correctly with respect to each other even when light or working conditions are not optimal. If for example the length of side A=the length of side B and both A and B are different from the length of side C (or if all three sides A,B,C are of a different length) a triangular plug according to the present invention is achieved, where said plug can be oriented correctly with respect to another plug without the need to fully see the plugs. This is due to the fat that it is not possible to connect two such triangular plugs if they are not oriented correctly with respect to each other. This is in contrast to e.g. circular or rectangular plugs.

Connectors

In some embodiments the connectors belong to dali+−, L1+N, L2+N, L3+N (e.g. 230V), and PE (ground) respectively, i.e. where 9 connectors are used. In this configuration the connectors for four circuits are arranged with a common ground. Here the four circuits are one 12 v and three 230V.

In some embodiments the connectors belongs to dali1+−, dali2+−, L1+N, L2+N, L3+N, and PE respectively, i.e. where 11 connectors are used. In this configuration the connectors for 5 circuits are arranged with a common ground. Here the five circuits are two 12 v and three 230V.

In some large embodiments the connectors belongs to dali1+−, dali2+−, dali3+−, L1+N, L2+N, L3+N, and PE respectively, i.e. where thirteen connectors are used. In this configuration the connectors for six circuits are arranged with a common ground. Here the six circuits are three 12 v and three 230V.

In smaller embodiments the connectors belongs to dali1+−, dali2+−, L1+N, and PE respectively, i.e. where seven connectors are used. In this configuration the connectors for 5 circuits are arranged with a common ground. Here the three circuits are two 12 v and one 230V.

In smaller embodiments the connectors belongs to dali1+−, L1+N, and PE respectively, i.e. where five connectors are used. Here the three circuits are one 12 v and one 230V.

The present plug can combine electrical circuits of 12V, 230V and 400V alone or in combination.

Plugs

A plug enabling connection of several and even different types electric circuits can be advantageous as it can minimize the number of parallel cables which may have to be installed. For example a plug with nine connectors limits the need for four different cables/installations to one. However, traditional e.g. rectangular or circular plugs becomes bulgy, long and/or complicated making identification of each connector hard.

A plug according to the present invention can be arranged so that the connectors forms a male (with connectors in form of pins) or a female plug (with connectors in form of holes) in order to achieve plugs which are connectable to each other.

In some embodiments the plug comprises a first end for receiving a cable and a second end arranged with the male or female connectors.

In various embodiments the plug comprises a first end having a first set of connectors (e.g. nine or eleven) and a second end arranged with a second set of connectors (e.g. nine or eleven). I.e. the plug comprises a first end arranged with male or female connectors and a second end arranged with male or female connectors.

In further embodiments one or more plugs according to the present invention are connected to another plug with a cable thus forming an extension.

Also plugs according to the present invention can comprise at least one further outlet thus forming a distributor plug. This further outlet is preferably also a triangular plug with connectors arranged according to the present invention.

Thus the plugs according to the present invention can be used in many different configurations providing a plug to different needs and situations.

If the plug comprises first and/or second lock parts for releasably locking two plugs together it is possible to avoid that the plugs are separated by accident. The lock formed by the first and second lock parts can be of different types. For example a first plug can have a hole and a corresponding second plug for connecting to the first plug can have a biased protrusion which can click into the hole of the first plug to lock the two plugs together. The biased protrusion can be pressed by a user thereby allowing the two plugs to be separated again. Plugs with first and/or second lock means may advantageously be used for example in permanent installations or in installations where there is a need for or a risk that one or more parts may be moved, pulled or otherwise handled after installation i.e. where there is a risk that two plugs may accidentally be separated.

In different embodiments the first side A is e.g. 1.5-4.5 cm depending on the intended use of the plug. A short side length provides a small, compact plug. A longer side length provides a larger plug where more connectors/electronic circuits can be arranged. Side lengths shorter or longer than 1.5-4.5 cm can be chosen to provide even smaller or larger plugs for example where very delicate connections must be made in little space or where a large number of electrical circuits must be connected by one plug.

The depth, i.e. the distance between first and second end can be chosen to make space for any internal connections to e.g. distributor plugs or to connections between wires from a cable and the connectors of the plug. Thus the depth can span from less than 1 cm to 20 cm or more depending on the intended use and number and type of cables and/or devices to be connected.

The corners and different sides of the plug can be sharp, rounded, truncated etc. to provide plugs with no or few sharp edges.

Plugs according to the present invention can be provided as closed units i.e. where the user cannot open or change the configuration of the internal parts and/or the connectors. Alternative embodiments where the user can open the plugs can be provided if it is advantageous to be able to change e.g. the configuration of the connectors.

The plug according to the present invention can be waterproof thus providing a plug which can be used with enhanced safety in moist conditions. Waterproofing can be provided by internal and/or external seals sealing openings in the plugs and/or preventing that moisture enters between two connected plugs.

The present invention also relates to a system comprising triangular female plugs, male plugs, distributor and/or extension plugs whereby a versatile system is achieved allowing use of the plugs in numerous configurations and for a variety of large and small installations.

A system may also comprise additional truncated plugs which fit into the triangular shape and the dimensions of the male, female, distributors and/or extensions of the system. Said truncated plugs comprising a subset of the connectors of the male, female, distributor and/or extension plugs of the system. For example truncated plugs can be used to engage in part of the output of a distributor plug. Truncated plugs can be used to mount on e.g. lamps or devices which are to be connected to an electrical installation comprising the present plugs but which lamp or device only require connection to a subset of the connectors in a male, female, distributors and/or extensions of the system. Truncated plugs may e.g. comprise from two connectors. In some embodiments systems comprising truncated male/female/distributor/extension plugs can be imagined e.g. where large systems of spots are to be mounted.

Rail

Preferably the system further comprises a rail which can hold one or more distributors and/or extensions according to the present invention.

Said rail can advantageously have means for receiving one or more distributors and/or extensions. These means can be arranged to fit with the different plugs, preferably distributor plugs, by sliding, twisting, pressing etc. the plug to be fastened on the means for receiving. Preferably the plug e.g. distributor and/or extensions are releasable attached in the rail.

In some embodiments the extensions are dimensioned to connect two distributors received in a rail. Several different types and lengths of extensions can be used but often preferably standard connector lengths are used. The length of the extensions can be adapted to correspond to the distance between two distributors arranged in a rail.

Type of Electrical Circuit

In some embodiments a plug is prepared for e.g. 7, 9, 10 or 11 connectors but only a subset of these are in use.

The type of electrical circuits relating to the connectors can be indicated by colour cording or other markings on the plug. It is also possible that codes are used to indicate which connectors are connected inside the plug. For example it can be imagined that a plug e.g. only has "active" dali+/− and L2, N2 which can be indicated on the plug by e.g. a colour code.

The different type of plugs according to the present invention can be hollow with internal connections (wires, cables, metal plates etc.) between connectors in the first side and corresponding connectors in the second side or between connectors in the first side and corresponding wires in a cable attached at second side or vice versa.

In other embodiments the plug is solid or at least partly solid with internal connections between connectors in the first side and corresponding connectors in the second side or between connectors in the first side and corresponding wires in a cable attached at second side or vice versa. The internal connections can advantageously be formed by metal conductors cast into the plug during manufacturing of the plug. In such solid or at least partly solid embodiments of different plugs according to the present invention, the internal connections can be protected to avoid short circuits by an electrical insulating material and/or the material from which the plug or part of the plug may be cast can be electrically insulating itself.

During manufacturing the internal connections can be arranged and fixated relatively to each other where after the plug is cast in one or more steps around the internal connections.

It is also possible that the ends of the connectors are fixated where after the ends and possibly other parts of the plug are cast. When the plug is cast around connectors fixated at their ends, the internal connections are preferably made of insulated conductors. The resulting plug, extension, distributor is preferably at least partly hollow.

A hollow plug, extension, distributor can be lighter and cheaper to produce as it contains less material. A solid plug, extension, distributor can be more sturdy and/or provide a fixed protection of the internal connections.

The pin connectors can be of various dimensions i.e. have a width and/or length adapted to the use of the plug.

The size and shape of the connectors can thus be chosen based on the intended use. The male connectors can e.g. be simple relatively thin pins, rounded pins with a larger diameter, flat pins and/or pins with a semi-circular cross section. The corresponding female connectors are arranged to match the shape of the male plugs and vice versa.

The female connectors can be holes adapted to receive the pin connectors. In several embodiments the female connectors are arranged with contact elements which are biased to press against the pin connectors to ensure a good electrical connection.

Plugs according to the present invention can be made of one or more materials for example from the group of plastics, rubber, resins, with electrical connectors and internal connections of various suitable conducting structures.

The present plugs can be arranged to comply with various international, regional or national safety protocols and requirements.

A plug can have one or more selector outlets having a number of connectors wherein at least a part of the connectors are arranged in one more selector parts, and wherein said one or more selector part is moveably arranged, and the configuration of the connectors are changed when one or more selector parts is moved. I.e. a selector output makes it possible for a user to choose the configuration of the connectors.

If e.g. a small plug (as a truncated plug) with five pins (a dali pair, a 230V pair and a ground) is mounted to a spot or other installation it is possible by means of the selector output to choose which of a number of connectors in a distributor plug will match the five pin connectors of the small plug.

Such a selector outlet can advantageously be arranged in e.g. a distributor plug with numerous electric circuits as described above and herein as it allows a user to choose which one or more of the many circuits inside the distributor plug will be connected to a device attached to the selector outlet.

A selector output as here described can however be arranged in various plug types not described herein where there is a need to change the configuration of all of or a part of the connectors.

Often the connector parts can be circular parts which are arranged to be rotatable between two, three, four or more different positions, preferably it is rotatable between three different positions.

In one embodiment the selector has a pairs of connectors for each position. It is preferred each of the pair would be bipolar and have their own phase.

If the connectors of the distributor plug are connected to the internal connections by wires inside the plug preferably rotation above 360 deg is prevented by a lock or stop.

Connector parts which are arranged to be moved in e.g. a sliding motion are also imagined.

Thus, according to the present invention is provided a plug and a system of plugs which enable coupling of numerous and different electrical circuits in a manner where the plugs intuitively are correctly aligned by the user due to the shape of the plugs. This means that the present plugs advantageously can be used where many and/or different electrical installations and connections must be made. It also means the present plugs can be handled in hard to reach places as well as in places with limited or no view of the work site. This is achieved by the shape of the present plug together with the way the connectors can be arranged in the plugs and assisted by the guiding parts, sleeves, collars, and coding all in all limiting the possible errors when handling, choosing and connecting the present plugs.

DESCRIPTION OF THE DRAWINGS

The invention will in the following be described in greater detail with reference to the accompanying drawings. The drawings are exemplary and are not to be construed as limiting to the invention.

DETAILED DESCRIPTION OF THE INVENTION

Figure 1:
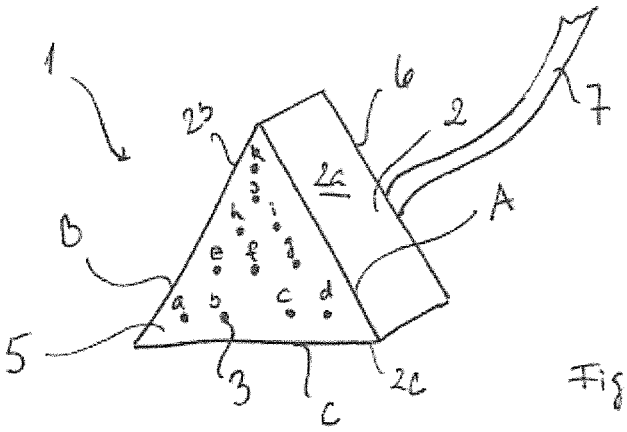
FIG. 1 shows a triangular female plug according to the present invention

FIG. 1 shows a triangular plug 1 according to the present invention. The plug comprises a housing 2 having three sides A, B and C and side surfaces 2*a*, 2*b*, 2*c*. In the present embodiment the sides A and B have the same length and are longer than the side C.

The housing has a first end 5 wherein eleven connectors 3 are arranged. Opposing the first end 5 is second end 6 wherein a cable 7 is attached. The cable 7 connects to the connectors inside the housing. The first, second and third surface extend between the first 5 and second end 6. In the present the example the plug is a she plug where each of the connectors 3 are holes for receiving pins from a corresponding male plug.

The connectors are stacked in a pattern following the triangular shape of the first end 5 i.e. follow the triangular cross section of the plug. Hereby is provided a quite compact plug where the space of the first end is fully utilized to provide several electric circuits arranged in a pattern which is simple and which makes it easy to determine which connector belongs to which electric circuit.

In this shown embodiment the connectors are: a,b=L1,N; c,d=L2,N; e,g L3,N; f=ground; h,i=dali1+, dali1−; j,k dali2+, dali2−.

Figure 2:
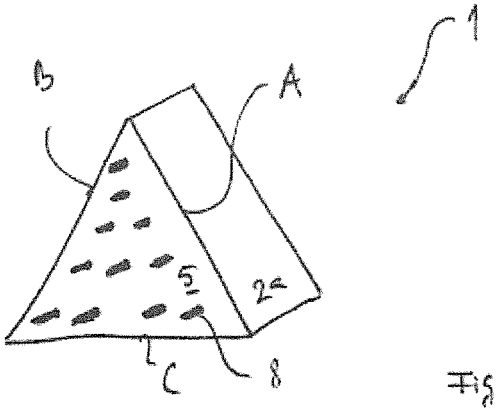
FIG. 2 shows a triangular male plug according to the present invention

FIG. 2 shows a male plug with pin connectors 8. This plug is shown without a connected cable 7.

Figure 3:
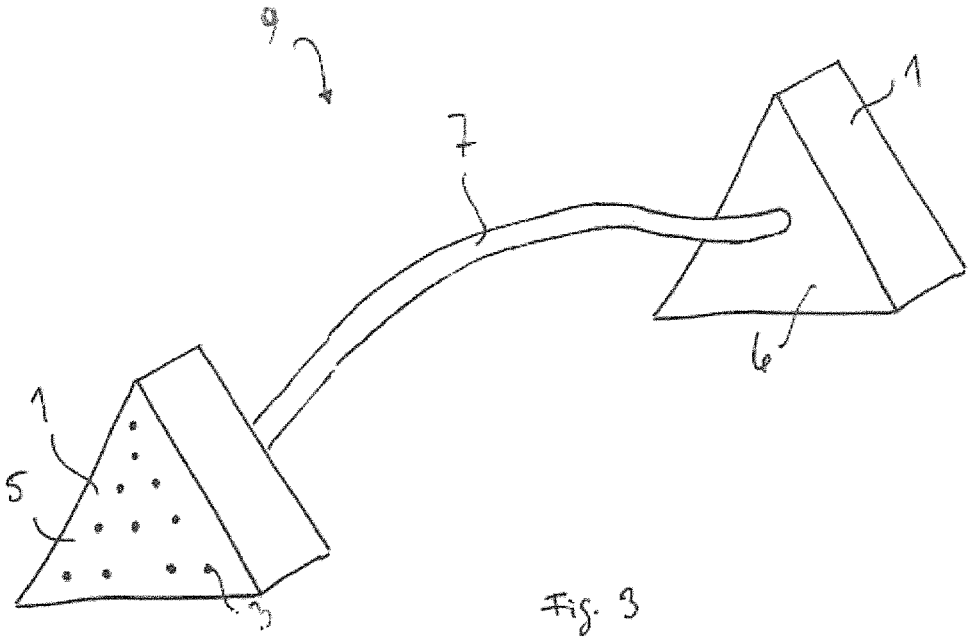
FIG. 3 shows an extension according to the present invention

FIG. 3 shows two plugs 1 connected by a cable 7 thus forming a connector 9. Depending on the intended use the plugs can be female and/or male plugs as well as the length of the cable can vary.

Figure 4:
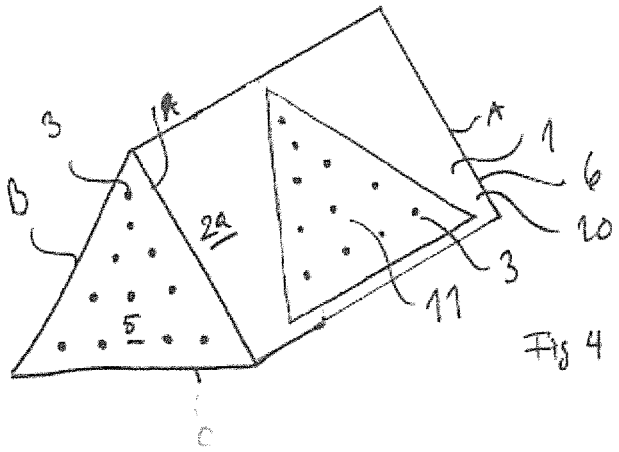
FIG. 4 shows a distributor according to the present invention

FIG. 4 shows a distributor plug 10. In this embodiment the distance between the first 5 and second end 6 are long enough to allow eleven connectors 3 to be arranged on the first surface 2*a* forming an outlet 11 thereby allowing a device or a plug to be attached not only at each of the first 5 and second end 6 but also at each of the surfaces 2*a* and/or 2*b* (not shown).

Figure 5:
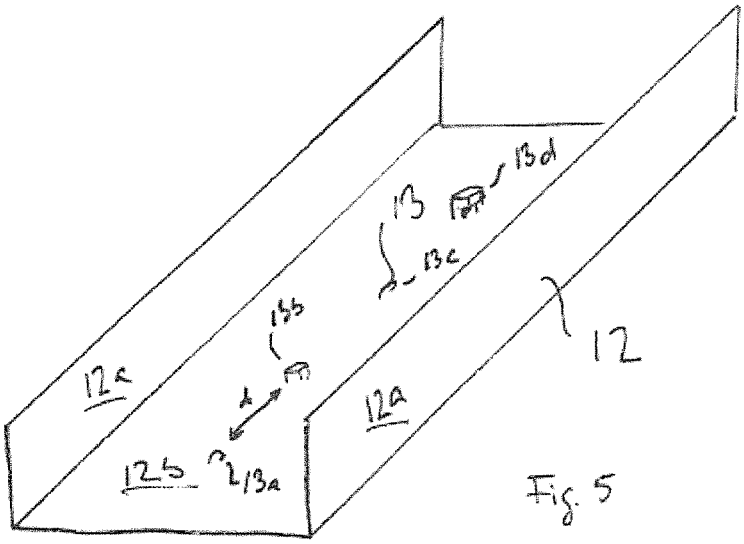
FIG. 5 shows a rail according to the present invention

FIG. 5 shows a rail 12. The rail is formed as an elongated element with a simple U shape formed by two side walls 12*a* and a bottom 12*b*. Along the middle of the bottom attachment means 13*a, b, c, d* are distributed spaced apart by a distance d. 13*a* is in the form of a partly circular protrusion. 13*b* is in form of a rectangular protrusion. 13*c* is in the form of a circular indentation and 13*d* is in the form of a protruding hook shape for slideably receiving e.g. a distributor (not shown).

Figure 6:
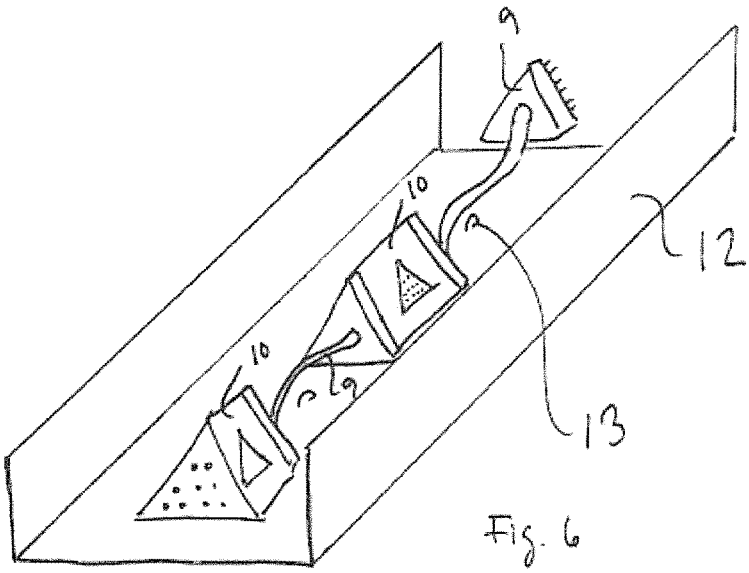
FIG. 6 shows a rail with distributors and extensions according to the present invention

In FIG. 6 two distributors 10 have been attached to attachment means 13 in a rail 12. The distributors are attached by engaging the attachment means 13 with corresponding means (not shown) in the distributors 10. The distributors are connected by connectors 9 thereby forming and array of connected distributors to which different installations such as spots, speakers, ventilations etc can be connected.

The setup of FIG. 6 can for example advantageously be used where numerous devices are to be installed across a loft or panel where each device requires electrical connection and even requires different current which can be provided by the novel present plug.

Figure 7:
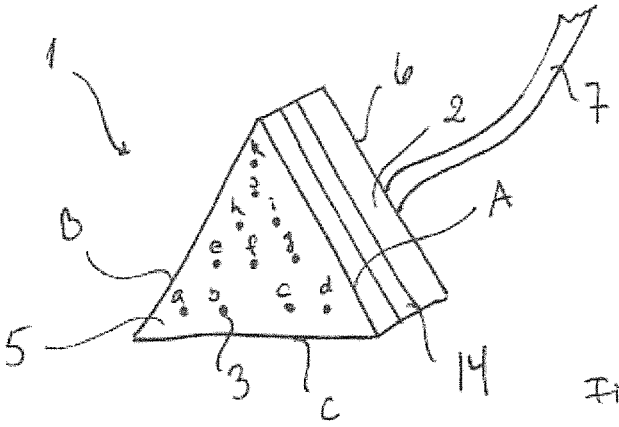
FIG. 7 shows a coded triangular plug according to the present invention

FIG. 7 shows a plug which is coded e.g. colour coded by mark 14. Coding of the plugs can advantageously be used where not all connectors (a-f) are connected to e.g. the cable 7 inside the housing of the plug.

Figure 8:
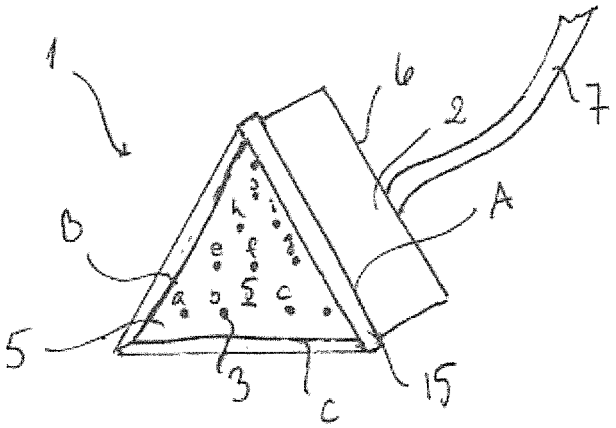
FIG. 8 shows a triangular plug according to the present invention with a sleeve

FIG. 8 shows a plug where a circumferential collar 15 is arranged around the first end 5. This collar 15 can e.g. be used to guide the engagement with another plug. If the collar is made of a e.g. rubber or silicone the collar may help avoid moisture entering the area between two plugs.

Figure 9:
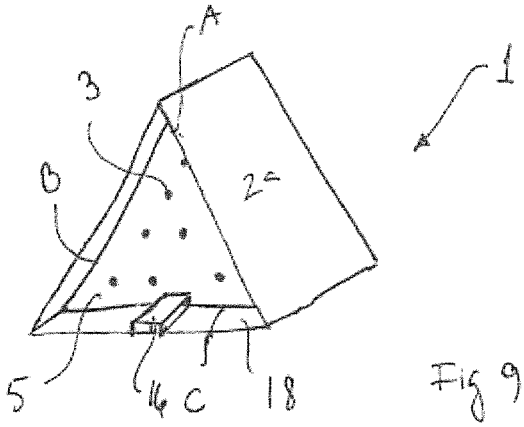
FIGS. 9 and 10 show plugs according to the present invention with corresponding guiding means
Figure 10:
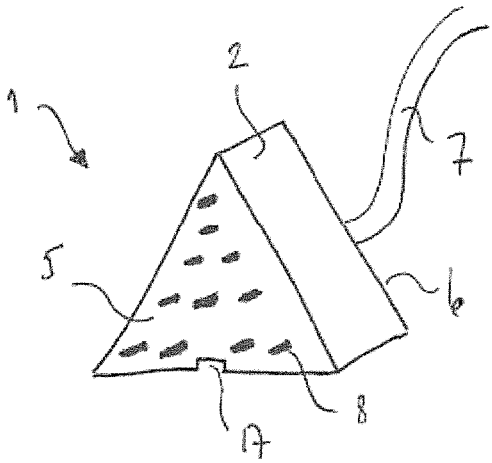

FIGS. 9 and 10 shows plugs with corresponding guiding parts here in the form of an elongated protrusion 16 on one for sliding into groove 17 on another plug. In the present embodiments the elongated protrusion 16 is on the female plug and the groove 17 is in the male plug however this can also be the other way around.

The guiding parts 16, 17 are used to assist the connection of the two plugs even further than what is achieved by the triangular structure alone. I.e. it may help that the two plugs are inserted in a way which may further prevent bending of the connectors.

In FIG. 9 the plug has sides extending further than the first end 5 thus forming a circumferential sleeve 18. This sleeve can have a function the same or similar to the collar 15 of FIG. 8. However the sleeve here is an integrated part of the plug whereas the collar 15 can be a detachable part of the plug.

Figure 11:
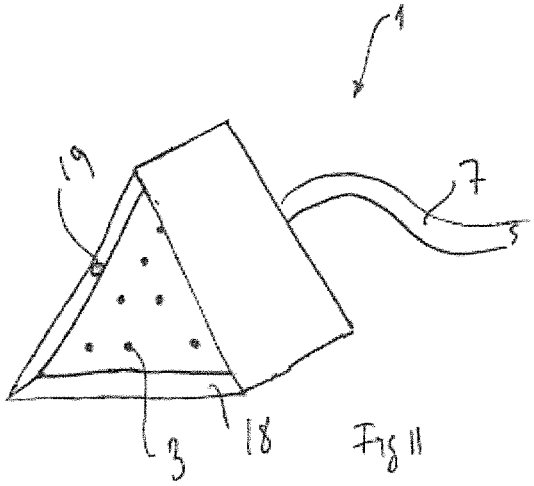
FIGS. 11 and 12 show plugs according to the present invention with corresponding lock means
Figure 12:
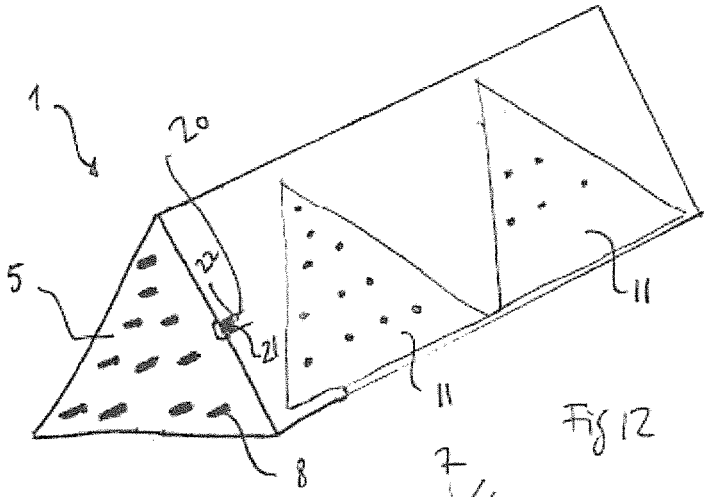

FIGS. 11 and 12 shows plugs with corresponding first 19 and second 20 lock means for locking the two plugs releasably together to avoid accidental disconnection. The first lock part is 19 a hole in the sleeve 18 which will be engaged by a knob 21 on the second lock means 20 when the two plugs are connected. The second lock means has the shape of a flap 22 which can be pressed inwards to allow engagement and disengagement of the two lock parts.

The plug in FIG. 12 is a distributor plug with two outlets 11 on one side (the side not shown can have similar or other outlets). In this embodiment the outputs 11 has eleven and five female connectors. The connectors 8 in the first end 5 are eleven male connectors 8.

Figures 13A, 13B, 13C:
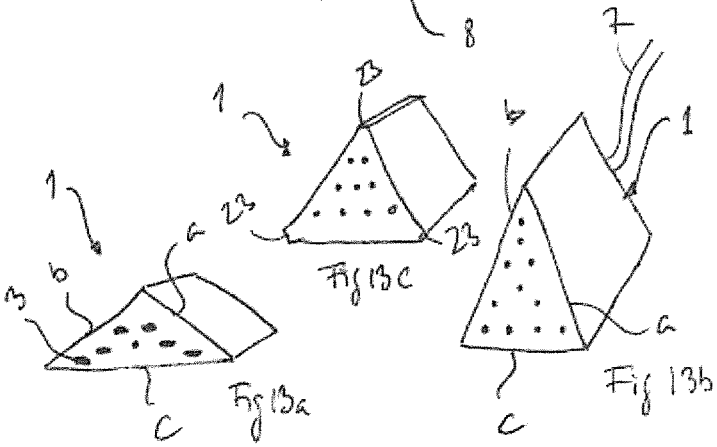
FIG. 13*a*, 13*b*, 13*c* show exemplary different embodiments of plugs according to the present invention.

FIG. 13*a*, 13*b*, 13*c* show different embodiments of female plugs according to the present invention. In FIG. 13*a* the third side C is significantly longer than sides A and B and the connectors 3 are here flat and elongated holes for receiving corresponding male pins in matching plugs. In FIG. 13*b* the sides A and B are significantly longer than side C. In FIG. 13*c* the sides A; B; C have the same length and the corners 23 are truncated.

Figure 14A:
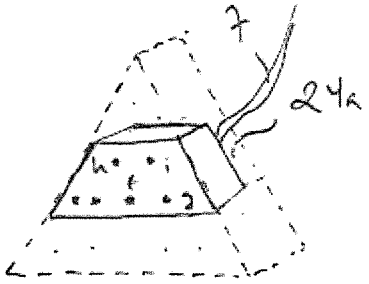
FIGS. 14*a* and 14*b* show truncated plugs matching a triangular plug
Figure 14B:
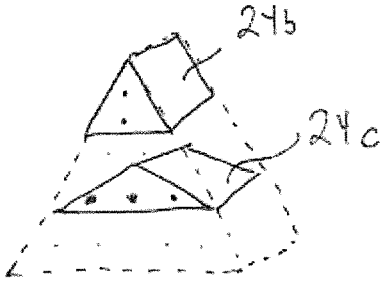

FIGS. 14*a* and 14*b* show different types of truncated plugs matching other types of plugs according to the present invention (indicated by dotted lines). A truncated plug as 24*a* and 24*b* can clearly be arranged to fit in one position only of another plug (dotted line). However, this can also be the case for 24*c* where the width of the plug can be chosen to allow precise positioning.

Figure 15:
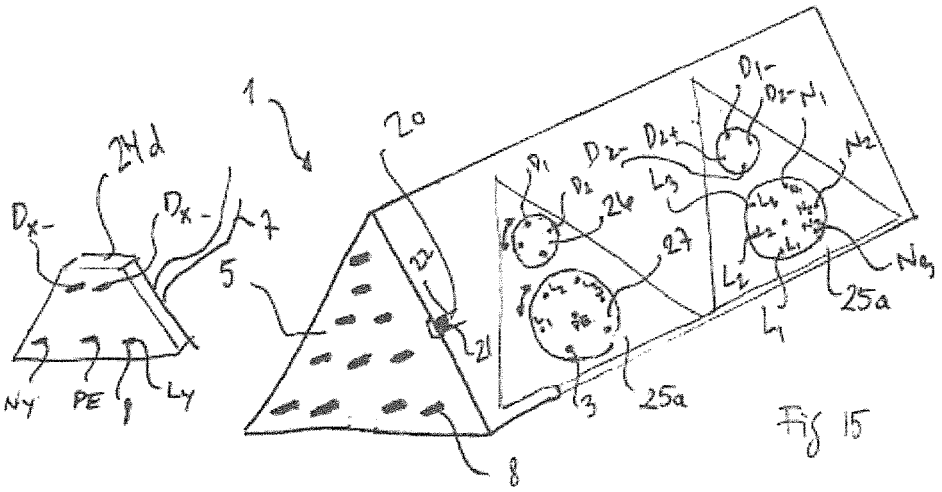
FIG. 15 shows a distributor plug with two selector outlets

FIG. 15 shows a distributor plug with two selector outlets 25*a*. The selector outlets each comprise a first selector part 26 (having two pairs of dali connectors) and a second selector part 27 having (three pairs of 230V connectors). In the present arrangement the first and second selector part are discs which can be moved more specifically rotated to change the configuration of the outlet 25*a*. A matching plug 24*d* has five pin connectors 8 which in the present configuration of first and second selector part of the left outlet in distributor plug will connect to Dali2+− and to L1, N1, PE. If the first selector part is rotated 90 deg counter clockwise the plug 24*d* will engage Dali1+− and L1, N1, PE. Similarly if second selector part is rotated 50 deg the plug 24*d* will engage Dali2+− and L2, N2, PE.

This way the selector outlets 25*a* allows the user to configure the connectors, by turning the first and second selector part, to select which connectors 3 will engage with the matching plug 24*d*. I.e. this way the special selector output enables a user to choose which of the several circuits in the distributor plug will be connected to a device attached to the plug 24*d*.

Figure 16:
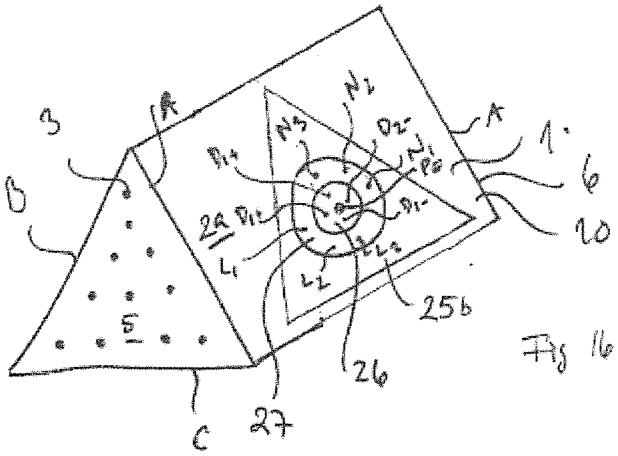
FIG. 16 shows a distributor plug with a single selector outlet

FIG. 16 shows a distributor plug with an alternative selector outlet 25*b* wherein the first 26 and second 27 selector part are arranged as two concentric circles.

Figure 17:
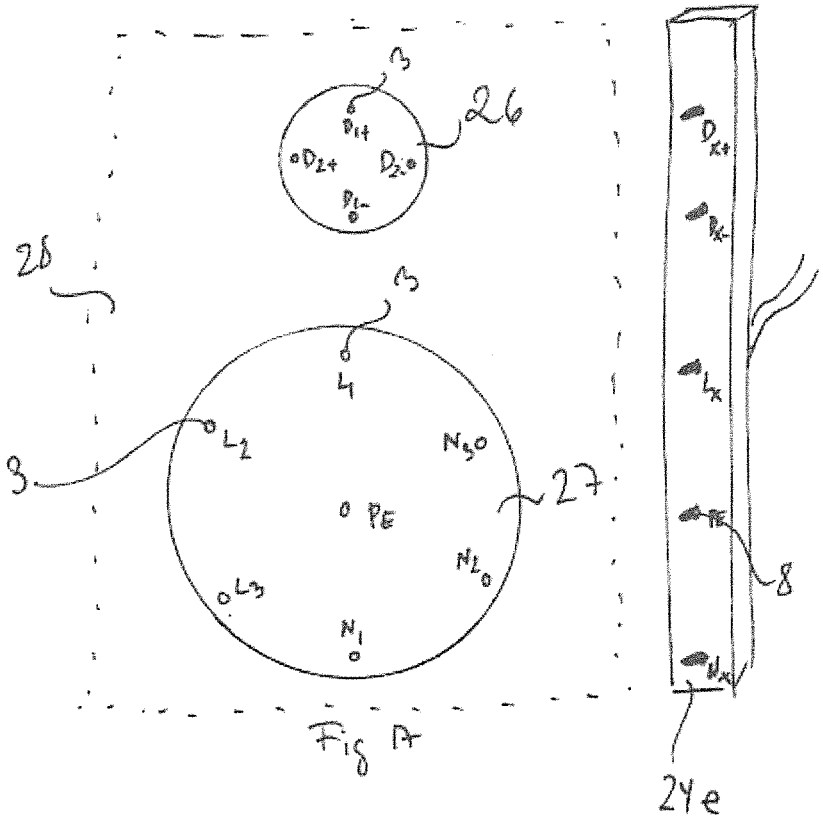
FIG. 17 shows a selector output with two separate circular selector parts

FIG. 17 shows an alternative outlet with a first 26 and second 27 selector part arranged to allow a user to select which five of the eleven connectors 3 will engage with matching connectors 8 in male plug 24*e*.

As in FIG. 15 the first and second selector part are a small circular rotatable part with two dali connector pairs and a larger circular rotatable part with three 230V/400V connector pairs and a common ground PE respectively.

In FIG. 17 the matching male plug is a rectangular narrow plug with a row of five pin connectors 8. Dx+ and Dx− are for connecting to one of the two dali pairs of the first selector part 26 and Lx, PE, Nx is for connecting to PE and one of the 230V/400V connector pairs of the second selector part 27.

Depending on the position of the first selector part 26 Dx will be either D1 or D2 (i.e. dali 1 or dali 2). Depending on the position of the second selector part 27 Lx,Nx will be either L1,N1 or L2,N2 or L3,N3.

Figure 18:
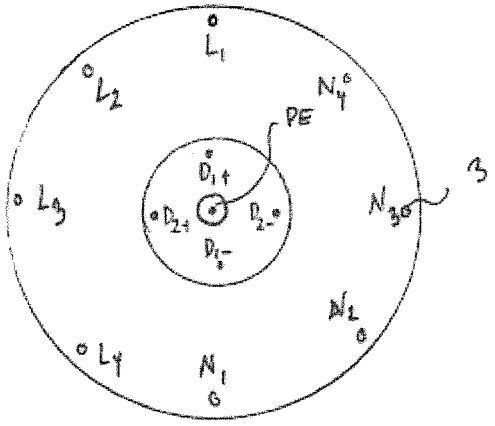
FIG. 18 shows a selector output with two concentric selector parts

FIG. 18 shows another embodiment of a selector outlet wherein the first and second selector part are arranged as two concentric rotatable parts. In this embodiment the second selector part 27 has four pairs of 230V/400V connectors L1,N1 L2,N2 L3,N3 L4,N4. A common ground PE is arranged in the centre. The first selector part 26 has two pairs of dali connectors dali1+− and dali2+−. I.e. this sector outlet comprises thirteen connectors.

The selector outlets of FIG. 17 and FIG. 18 can be arranged in triangular plugs as described herein or in other types of plugs 28 with another geometry. Generally the selector outlet can advantageously be used in plugs with several circuits wherein only one or a subset of the total electrical circuits needs to be connected to a device or other plug.

Figure 19:
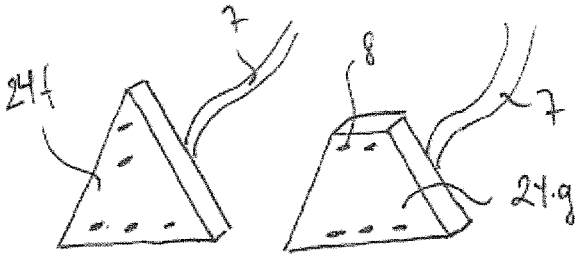
FIG. 19 shows two embodiments of plugs matching a selector outlet.

FIG. 19 shows a triangular and a truncated triangular embodiment of plugs with five pin connectors for engaging in a selector outlet as e.g. in FIG. 15 or FIG. 17.

Figure 20:
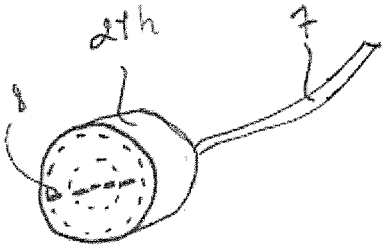
FIGS. 20 and 21 shows two further embodiments of plugs matching a selector outlet.
Figure 21:
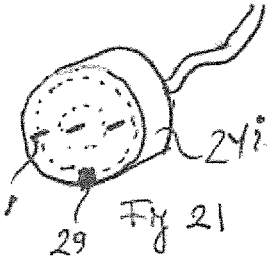

FIG. 20 shows a circular male plug 24*h* with five pins 8 connectors. FIG. 21 shows a circular male plug 24*i* with three pin connectors 8. Both plugs can engage with e.g. selector outlets with concentric selector parts as in FIG. 16 and FIG. 18.

Figure 22A:
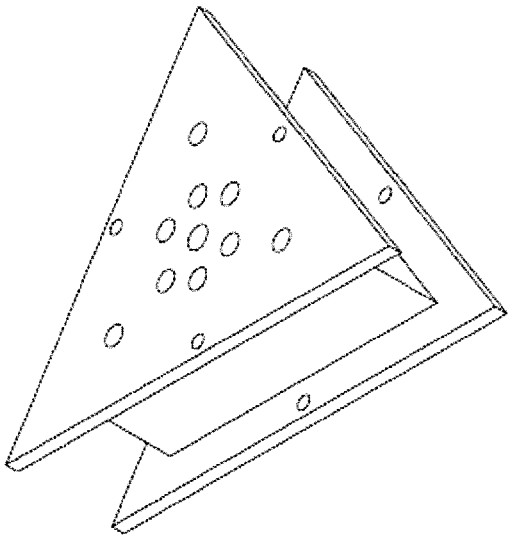
FIGS. 22*a* and 22*d* show an assembled system of two triangular plugs
Figure 22B:
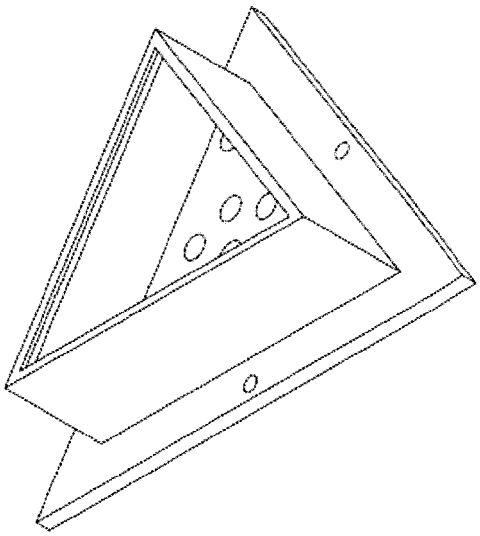
FIGS. 22*b* and 22*c* show two triangular plugs used to form an assembled system
Figure 22C:
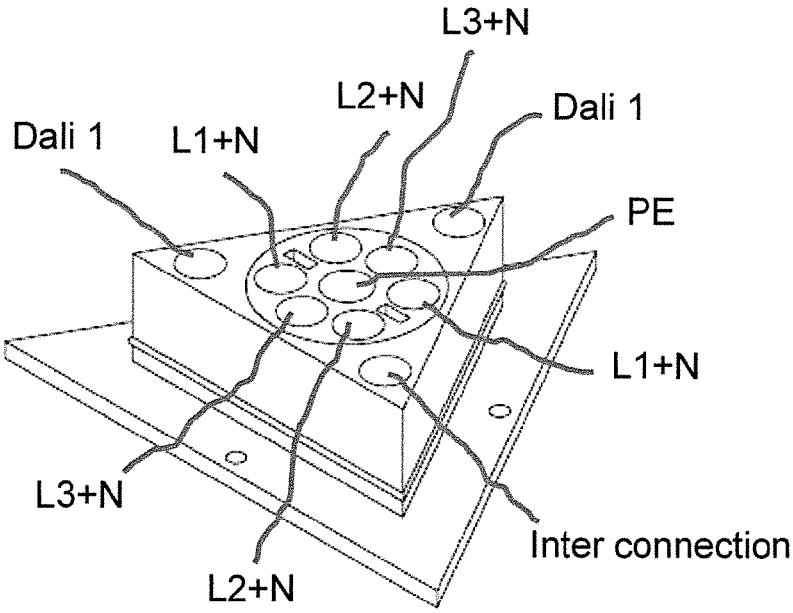
Figure 22D:
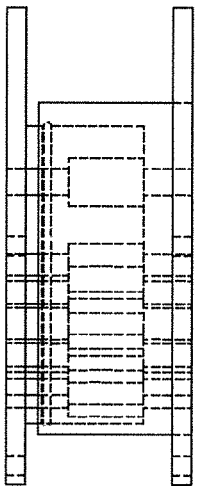

FIGS. 22*a* and 22*d* show an assembled system of two triangular plugs consisting of two triangular plugs as shown in FIGS. 22*b* and 22*c*. FIG. 22*c* shows a configuration wherein the different connectors are female and rotationally arranged. The connectors are rotatable between three different positions, such that the selector has three pairs of connectors, i.e. a pair of L1+1, a pair of L2+1 and pair of L3+1. FIG. 22*b* shows a male plug, however the pins are not shown. The housing is an equilateral triangle but it could be scalene.

Figure 23A:
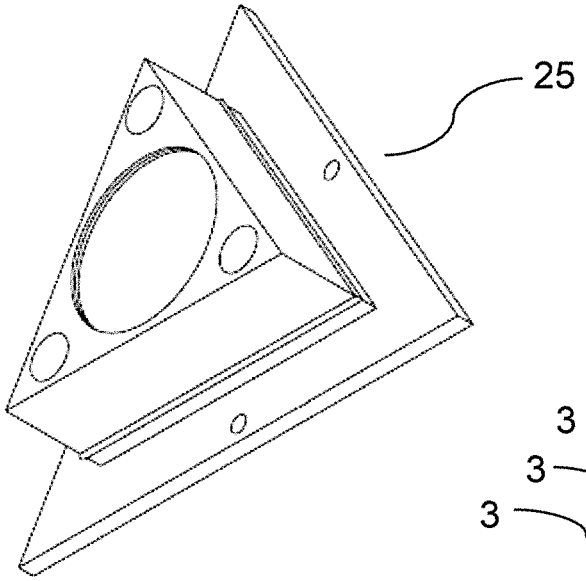
FIG. 23*a* shows a triangular housing for a plug
Figure 23B:
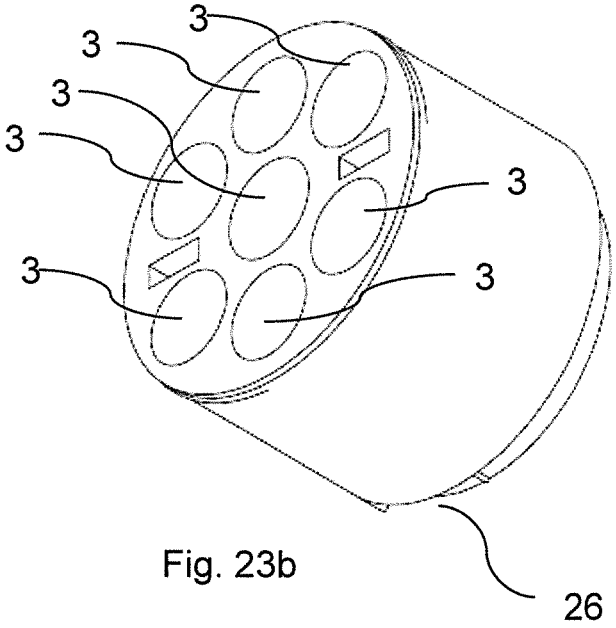
FIGS. 23*b* and 23*c* show a selector outlet for a plug
Figure 23C:
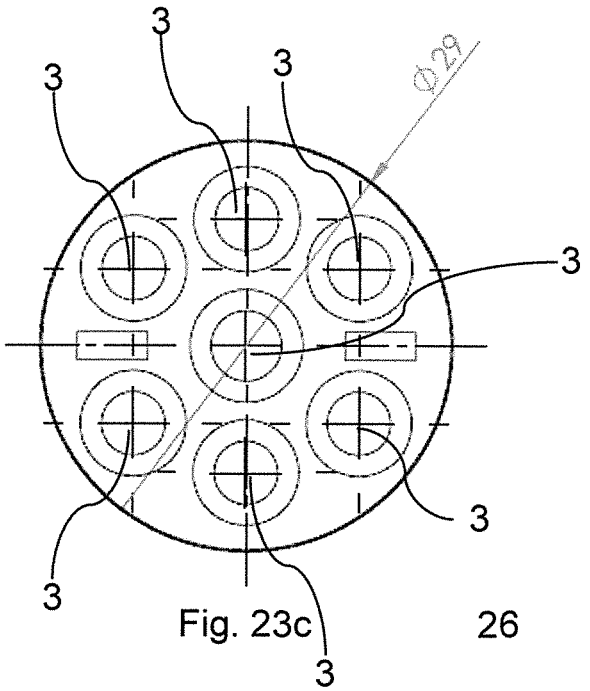

FIG. 23*a* shows a triangular housing for a plug, wherein a selector output with one selector part as shown in cross section in FIG. 23*c* and in perspective in 23*b* can be inserted. The selector part is rotationally arranged and is shown with female connectors. The housing is an equilateral triangle but it could be scalene.

The above figures each show different features of the present invention which features can be combined in various ways. E.g. the sleeve 18 or collar 15 can form part of male plugs, distributors and/or extensions. Similarly guides, locks, connectors of different shape/size and truncated corners can form part of the various embodiments.

Thus according to the present invention is provided a plug which can be arranged in numerous ways, male and/or female, as an extension and a distributor providing a new type of plugs enabling the connection of a multitude of electric circuits by one compact plug. The plugs can be arranged to connect different types and numbers of electric circuits as well as they can be arranged to provide a very intuitive orientation of the plugs ensuring correct and fast connection of two plugs.

The invention claimed is:

1. A plug for allowing connection to an additional plug for connecting different types and numbers of electric circuits, comprising:

a plug housing having a first end;

a first plug part supported by the housing towards the first end and defined by a first plurality of electrical connectors, wherein the electrical connectors are formed as female or male connectors; and a selector part movably supported by the plug housing towards the first end and accommodating a second plurality of electrical connectors, the second plurality of electrical connectors formed as female or male connectors, at least a part of the second plurality of electrical connectors defining a second plug part;

wherein the first plug part together with the second plug part provides for connection to the additional plug, and wherein there are more than one positional configurations of the second plug part relative to the first plug part due to the movement of the selector part.

2. The plug according to claim 1, wherein the plus housing is selected from the group consisting of a rectangular housing, a triangular housing, and a circular housing.

3. The plug according to claim 2, wherein the plug housing has a triangular cross section defined by a side A, a side B and a side C, wherein the length of side A=the length of side B.

4. The plug according to claim 3, wherein the side A is 1.5-4.5 cm.

5. The plug according to claim 3, wherein at least one of the three surfaces defined by side A, B or C, respectively, comprises a guiding part.

6. The plug according to claim 1, wherein the total number of electrical connectors is 9 or 11.

7. The plug according to claim 1, wherein the electrical connectors are dali+–, L1+N, L2+N, L3+N, PE or dali+–, dali2+–, L1+N, L2+N, L3+N, PE.

8. The plug according to claim 1, wherein PE ground is in the center of the selector part and shared between the circuits.

9. The plug according to claim 1, wherein the plug housing comprises a second end arranged with male or female connectors.

10. The plug according claim 1, wherein the plug is connected to another plug by a cable thus forming an extension.

11. The plug according to claim 1, further comprising a first and/or second lock parts.

12. The according to claim 1, wherein the plug is waterproof.

13. The plug according to claim 1, wherein the plug housing comprises a second end arranged with a cable.

14. The plug according to claim 1, wherein the plug housing is an equilateral triangle.

15. An assembly of two or more plugs, wherein the plugs are plugs according to claim 1.

16. The plug according to claim 1, wherein the selector part is rotationally arranged in the plug housing, whereby the positional configuration of the electrical connectors is changed when the selector part is rotated.

17. The plug according to claim 1, further comprising an additional selector part accommodating a plurality of electrical connectors, the plurality of electrical connectors including the first plurality of electrical connectors, wherein the additional selector part is movably arranged in the plug housing.

* * * * *